US006962172B2

(12) United States Patent
Zorini et al.

(10) Patent No.: US 6,962,172 B2
(45) Date of Patent: Nov. 8, 2005

(54) TEXTILE MACHINE AND CONTROL METHOD THEREOF

(75) Inventors: Luigi Omodeo Zorini, c/o Comez S.p.A., Via Enrico Fermi, 5 - P.O. Box 5 - 27024, Cilavegna (Pavia) (IT); Pierantonio Franchino, Robbio (IT)

(73) Assignee: Luigi Omodeo Zorini, Cilavegna (IT)

( * ) Notice: Subject to any disclaimer, the term of this patent is extended or adjusted under 35 U.S.C. 154(b) by 0 days.

(21) Appl. No.: 10/965,483

(22) Filed: Oct. 14, 2004

(65) Prior Publication Data

US 2005/0086978 A1 Apr. 28, 2005

(30) Foreign Application Priority Data

Oct. 22, 2003 (EP) ..... 03425689

(51) Int. Cl.[7] ..... D03D 47/42
(52) U.S. Cl. ..... 139/429
(58) Field of Search ..... 139/440–442, 139/431–432, 103, 309; 66/82 A, 204, 231, 66/232, 237

(56) References Cited

U.S. PATENT DOCUMENTS 4,305,434 A * 12/1981 Muller ..... 139/431
4,577,665 A 3/1986 Diesner
4,582,095 A * 4/1986 Kronholm ..... 139/1 R
4,662,407 A * 5/1987 Duncan ..... 139/103
5,069,257 A 12/1991 Borisch
5,568,826 A * 10/1996 Vogel et al. ..... 139/25
5,947,161 A 9/1999 Speich
2003/0075231 A1 4/2003 Wendisch et al.

FOREIGN PATENT DOCUMENTS

DE 19816666 A1 10/1999
WO WO02/052082 A1 7/2002

* cited by examiner

*Primary Examiner*—Danny Worrell
(74) *Attorney, Agent, or Firm*—Pearne & Gordon LLP

(57) ABSTRACT

A textile machine comprising at least one frame (2) supporting a plurality of healds (3), a sickle (6), a needle (8), a compacting device (201) and a main shaft (12) for a synchronized movement of the frames (2), sickle (6), needle (8) and compacting device (201) and manufacture of a textile product (5); the machine (1) further comprises a first feeding member (20) to supply a plurality of warp yarns (18) to said healds, a second feeding member (40) to supply at least one weft yarn (19) to said sickle and a take-down member (60) of said textile product (5). The machine (1) is also provided with a control apparatus (80) comprising at least one first electromechanical actuator (30) operatively active on said first or second feeding member (20, 40) or on said take-down member (60) for movement of the same, and a controller (90) for regulation of at least said first actuator (30).

24 Claims, 6 Drawing Sheets

TEXTILE MACHINE AND CONTROL METHOD THEREOF

FIELD AND BACKGROUND OF THE INVENTION

The present invention relates to a textile machine and the control method thereof.

It is known that in textile machines such as needle looms, among which also the crocheting machines are included, formation of the textile product takes place by mutual interlacing, following predetermined patterns, of a plurality of warp and weft yarns, suitably engaged by respective weaving or knitting members; the latter are for example the healds mounted on one or more heald frames, a predetermined number of sickles and at least one needle.

Also present are auxiliary members such as weft-yarn knocking-over devices and compacting reeds.

These weaving members are operated, through appropriate actuators or kinematic mechanisms of the mechanical type, through synchronized cyclic movements to cause mutual intertwining of the warp yarns and weft yarns following the desired knitting pattern.

The weft yarns are fed to the respective weaving members by a plurality of bobbins mounted on a rack-shaped structure called "unwinding creel", while the warp yarns are unwound from a plurality of beams supported by a beam-carrying unwinding creel.

It is also provided that appropriate take-down rollers should cause sliding of the textile product and progressive supply of same to the machine exit.

The bobbins on which the weft yarns are wound are free to rotate about their longitudinal rotation axis, and the tension with which the weft yarns are fed to the respective sickles is determined by the rotation speed of the rollers that are interposed between the bobbins and the sickles and are disposed close to each other so as to engage the weft yarns.

Rotation of these rollers is usually caused by a kinematic connection between said rollers and the main shaft of the textile machine; since this connection is of a purely mechanical type, it keeps a fixed position during production of the whole fabric.

Therefore, each sickle always receives the same amount of weft yarn in a time unit and, to vary this amount, the machine is to be stopped and the kinematic connection ratios between the main shaft and said rollers are to be modified.

Likewise, the warp yarns too are fed to the healds through rollers disposed suitably close to each other and the finished product is picked up from the machine by a quite similar roller member.

Both the warp yarn feeding member and the textile-product take-down member are mechanically connected with the main shaft, so that the follow-up ratio (i.e. the ratio between the number of revolutions carried out in the time unit by the feeding/take-down rollers and the number of revolutions carried out in the time unit by the main shaft) keeps constant over the whole working of the textile product.

Consequently, it is not possible to alter tensioning of the weft and warp yarns when supplied to the respective bars without stopping operation of the machine, neither is it possible to modify the pulling tension applied when the finished product is removed from the machine.

Therefore, by adopting these modalities of use of the loom it is not possible to alter the fabric compactness or density both in a transverse direction and in a direction parallel to the extension of the textile product, without stopping operation of the machine.

In addition, exactly due to the fact that the warp and weft yarns are fed to the healds and sickles respectively at a constant tension and the textile product is caused to slide between the take-down rollers at a constant tension in time, it is not possible to obtain particular aesthetic effects through a controlled variation of the fabric compactness, without stopping operation of the machine, said aesthetic effects comprising alternations of thinner and more compact regions, narrowing or shrinkage of the textile product along a direction substantially perpendicular to the movement direction in which the textile product itself is moved by the take-down rollers, etc.

SUMMARY OF THE INVENTION

It is an aim of the present invention to solve the above mentioned drawbacks. In particular, the present invention aims at making available a textile machine and the control method thereof, that are able to vary tensioning of the weft yarns when supplied to the sickles, without stopping operation of the machine.

Another aim of the invention is to provided a textile machine, and the control method thereof, allowing the take-down tensioning of the textile product coming out of the machine to be varied without stopping operation of the machine.

It is a further aim of the invention to provide a textile machine and the control method thereof, allowing articles of manufacture having portions of different compactness, in a direction both parallel and transverse to the extension of the product itself, to be made in an automatic manner.

The foregoing and further aims are substantially achieved by a textile machine, and the control method thereof, in accordance with the features set out in the appended claims.

BRIEF DESCRIPTION OF THE DRAWINGS

Further features and advantages will become more apparent from the detailed description of a preferred embodiment of a textile machine and the control method thereof, given hereinafter by way of non-limiting example with the aid of the accompanying drawings, in which.

DESCRIPTION OF THE PREFERRED EMBODIMENT

Figure 1:
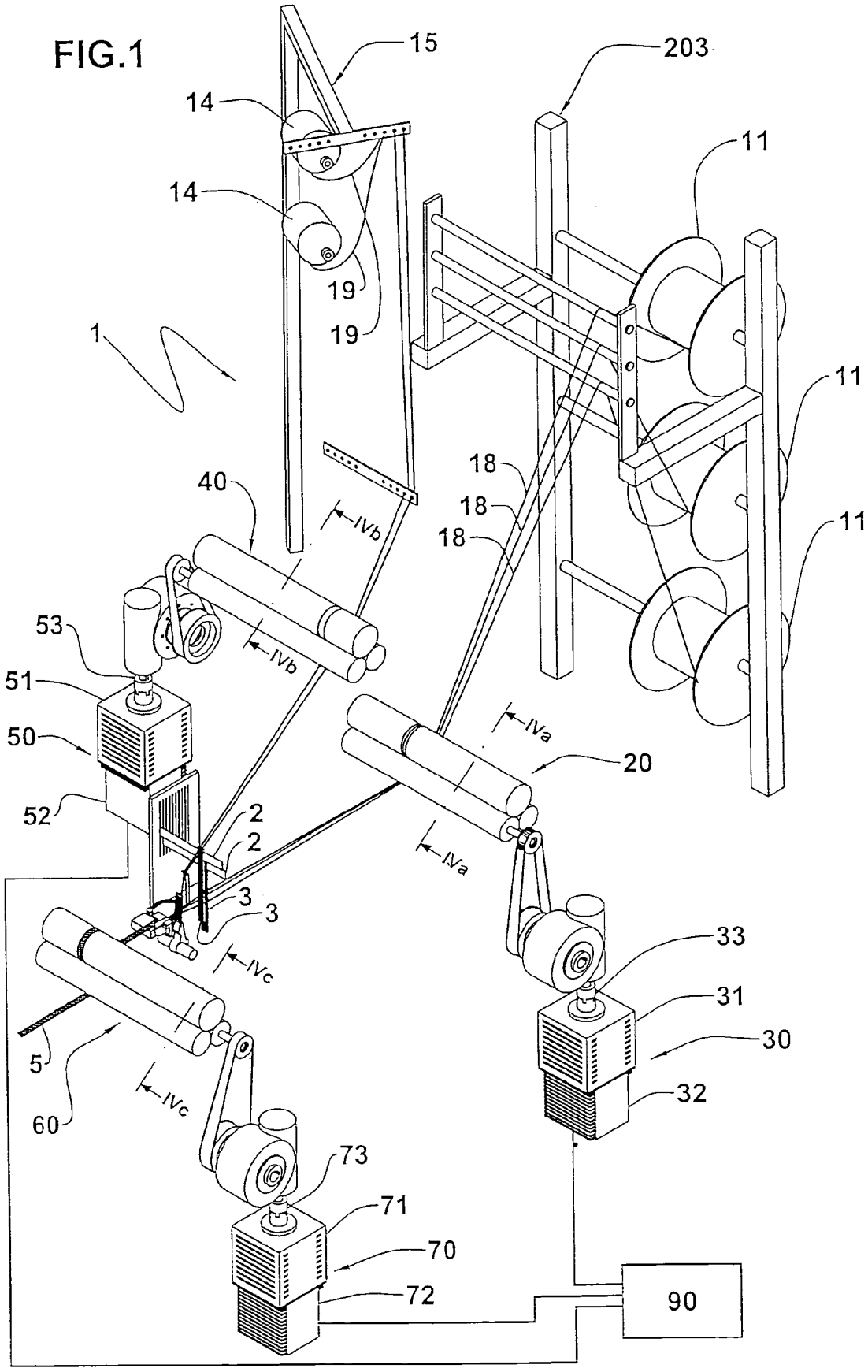
FIG. 1 is a partly diagrammatic perspective view of a textile machine in accordance with the present invention.

With reference to the drawings, a textile machine in accordance with the present invention has been generally identified by reference numeral 1.

The textile machine 1 that preferably is a needle loom, comprises a plurality of frames 2, on each of which a plurality of healds 3 is mounted; it is to be noted that in FIG. 1, for the sake of clarity, only a horizontal portion of each frame 2 has been shown.

Each heald 3 has a slot 4 adapted to engage a respective warp yarn 5. Each frame 2 is moved in a substantially vertical direction, between two or three operating positions; corresponding to each of said operating positions is a different height at which the slots of healds 3 supported by said frame 2 are positioned.

Frames 2 can be directly connected with the main shaft 12 of loom 1, by means of a cam chain, or they can be moved by electromechanical actuators, suitably operated in accordance with preset programs.

The machine 1 further comprises at least one sickle 6 that at an end thereof has an engagement portion 6*a* to guide the weft yarn 19 towards the warp yarns 18.

Sickle 6 carries out a reciprocating motion so that the engagement portion 6*a* cyclically moves close to and away from the warp yarns 18 following an arched trajectory lying in a substantially horizontal plane.

Also provided is a needle 8 disposed side by side with said warp yarns 18 to hold the weft yarn 19 and enable interlooping of same with the warp yarns 18.

A knocking-over device 200 ensures engagement of the weft yarn 19 with the hooked end portion 8*a* of needle 8; a compacting reed 201 pushes the weft yarn 19 onto the already made fabric portion 5 to improve mutual engagement between the warp yarns 18 and the weft yarn 19 itself.

The warp yarns 18, depending on the type of product to be made, can be disposed on two or three rows; if two rows of warp yarns 18 are employed, each frame 2 will be shiftable between two operating positions, while if three rows of warp yarns 18 are employed, each frame 2 will be shiftable between three operating positions.

The warp yarns 18 of each row are unwound from a corresponding beam 11; the beams 11 are supported by a beam-carrying creel 203. For the sake of clarity, a single warp yarn 18 of each row has been shown in FIG. 1.

Operation of the textile machine 1 is now briefly described.

Figure 2:
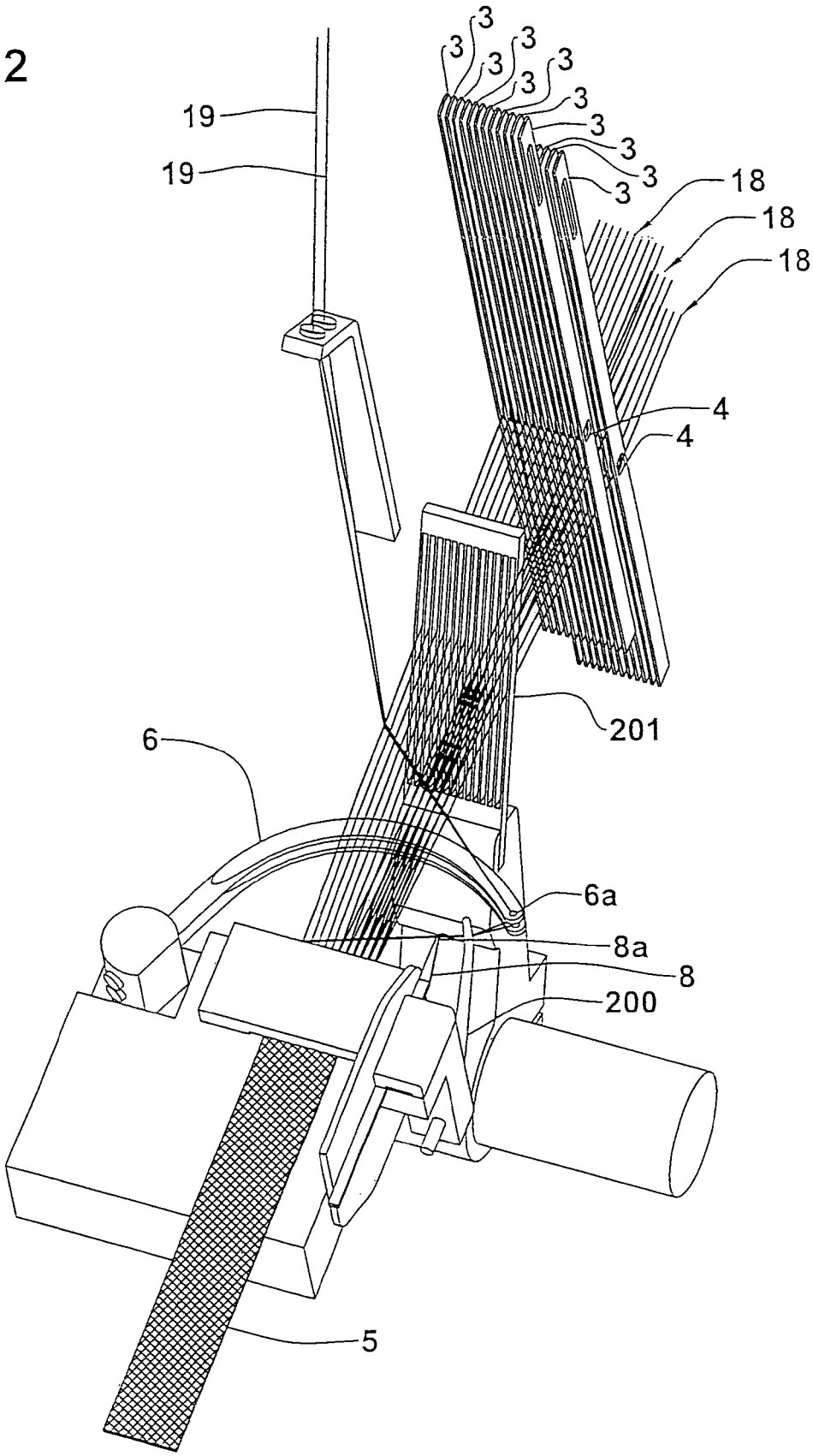
FIG. 2 is a detailed view of a first operating step of the machine in FIG. 1.

During a first operating step of loom 1 (FIG. 2), sickle 6 takes a first operating position, at which the weft yarn 19 portion guided by sickle 6 is positioned transversely of the warp yarns 18, so as to engage the latter for making a new weft row of fabric 5.

Under this condition, the knocking-over device 200 exerts a downward pressure on the weft yarn 19, so that the latter is engaged with the hooked portion 8*a* of needle 8.

Figure 3:
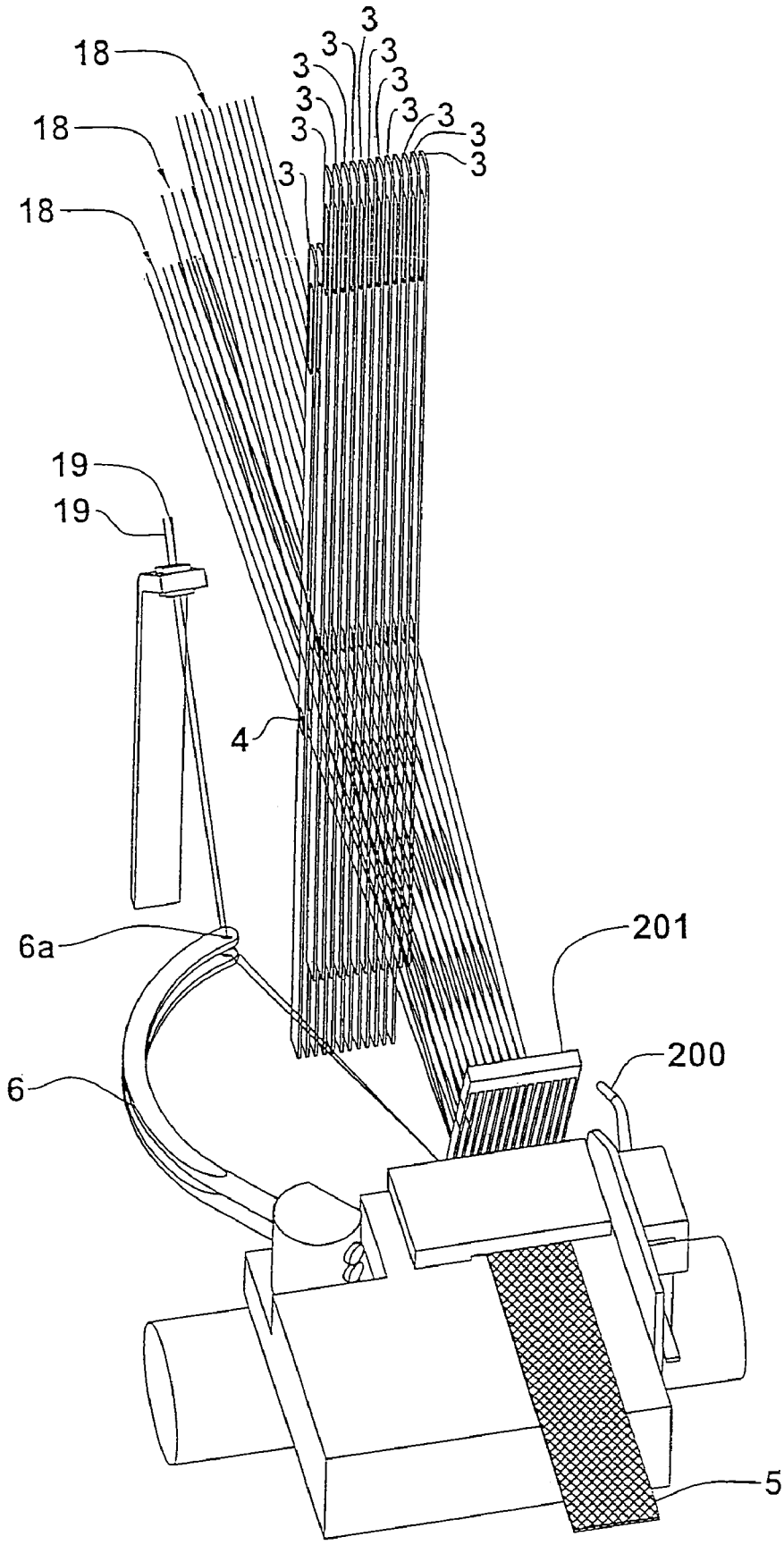
FIG. 3 is a detailed view of a second operating step of the machine in FIG. 1.

In a second operating step (FIG. 3), the sickle 6 is retracted so as to move its engagement surface 6*a* away from needle 8; concurrently, the knocking-over device 200 moves upwardly, allowing the needle 8 to take a retracted position, guiding the weft yarn 19 until bringing it into contact with the already made fabric portion 5.

Subsequently, the compacting reed 201 is moved close to fabric 5, to press the weft yarn 19 against the already made fabric portion 5, and lock the new position taken by the weft yarn 19 in fabric 5.

Finally, the compacting reed 201 moves away from the fabric 5, and healds 3 are moved in accordance with the predetermined work program, thus starting a new operating cycle of the machine 1 for manufacture of a subsequent weft row.

The fabric 5 is therefore defined by a succession of weft rows in engagement with said warp yarns 18; each weft row is defined by the portion of weft yarn 19 interlooped with the warp yarns 18 in a working cycle.

Therefore, each weft row of the fabric 5 corresponds to performing all the above operating steps once.

Each weft yarn 19 is wound around a corresponding bobbin 14, mounted on a unwinding creel 15 and is progressively fed to sickle 6 for manufacture of the textile product 5.

Interposed between beams 11 and frames 2 is a first feeding member 20 to supply the healds with the respective warp yarn 18.

In the preferred embodiment, the first feeding member 30 comprises a first roller 21, a second roller 22, close to the first roller 21, and a third roller 23 close to the second roller 22.

The first roller 21 has a first bearing arc 21*a* with which the warp yarn 18 is engaged during supply of said warp yarn to sickle 6; the first bearing arc 21 has a first end 21*b* and a second end 21*c* confining the roller portion on which the warp yarn 18 lies.

Likewise, the second roller 22 has a second bearing arc 22*a* having a first end 22*b* and a second end 22*c*; the third roller 23 has a third bearing arc 23*a* having at least one end 23*b*.

Figure 4A:
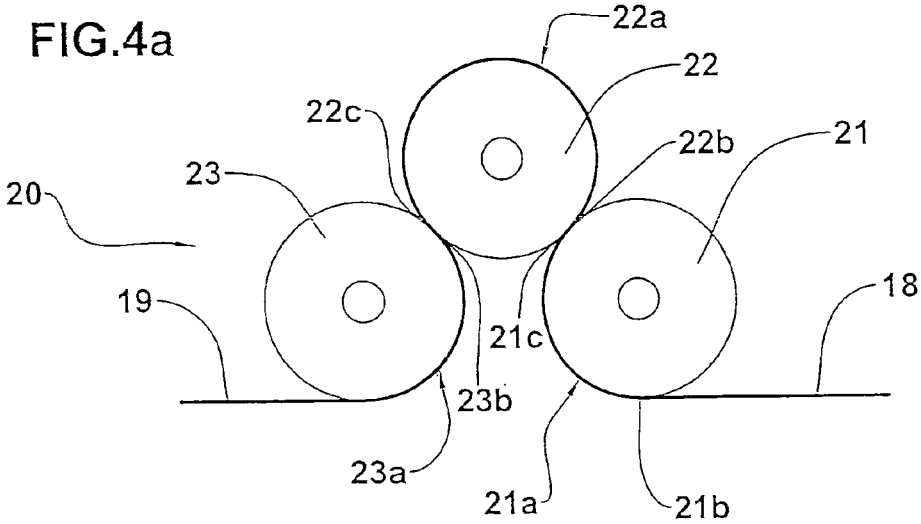
FIG. 4*a* diagrammatically shows a section along line IVa—IVa of the machine in FIG. 1.

Preferably, as shown in FIG. 4*a*, rollers 21, 22 and 23 are disposed close to each other so that the second end 21*c* of the first bearing arc 21*a* is coincident with the first end 22*b* of the second arc 22*a* and the second end 22*c* of the second bearing arc 22*a* is coincident with the first end 23*b* of the third arc 23*a*.

A first electromechanical actuator 20 is connected with the first feeding member 20, to drive said rollers 21, 22 and 23 in rotation and supply the healds 3 with the respective warp yarn 18 at a given tension that, as better clarified in the following, can be varied during manufacture of the textile product 5.

In more detail, the first electromechanical actuator 30 is made up of an electric motor 31, preferably a brushless motor, and of an electric activation device 32 for powering and controlling motor 31. The electric motor 31 is provided with an output shaft 33 that, when powered by said activation device 32, is driven in rotation.

The output shaft 33 is connected with the first and preferably the third rollers, 21, 23, of the first feeding member 20, whereas the second roller 22 is idly mounted on a respective rotation axis; therefore by varying the rotation speed of the output shaft 33 it is possible to regulate tensioning of the warp yarns 18 when supplied to healds 3.

A second feeding member 40 is interposed between the bobbins 14 and sickle 6 to supply the latter with the weft yarn 19.

Figure 4B:
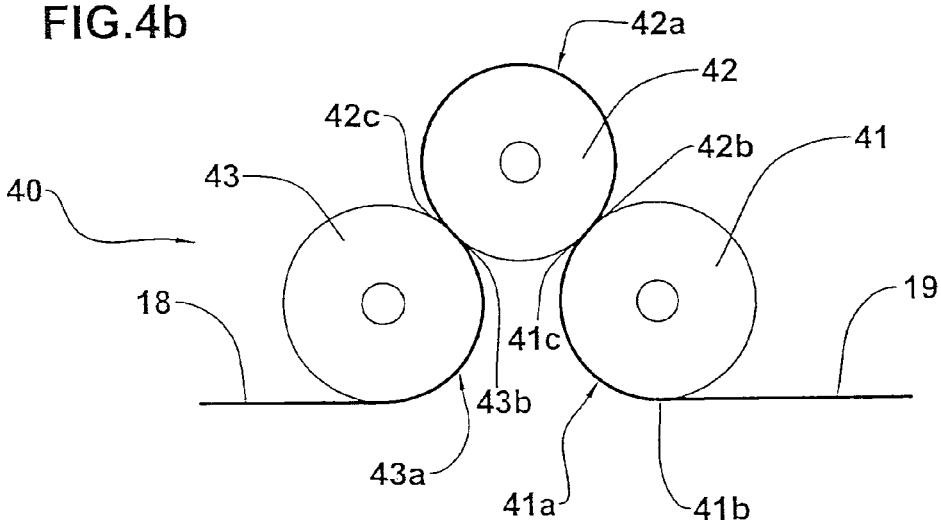
FIG. 4*b* diagrammatically shows a section along line IVb—IVb of the machine in FIG. 1.
Figure 4C:
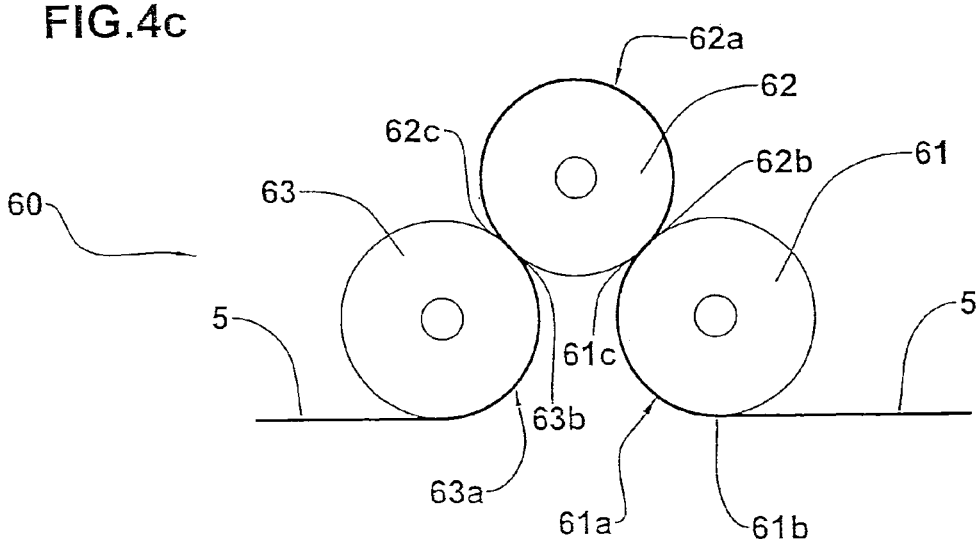
FIG. 4*c* diagrammatically shows a section along line IVc—IVc of the machine in FIG. 1.
Figure 5:
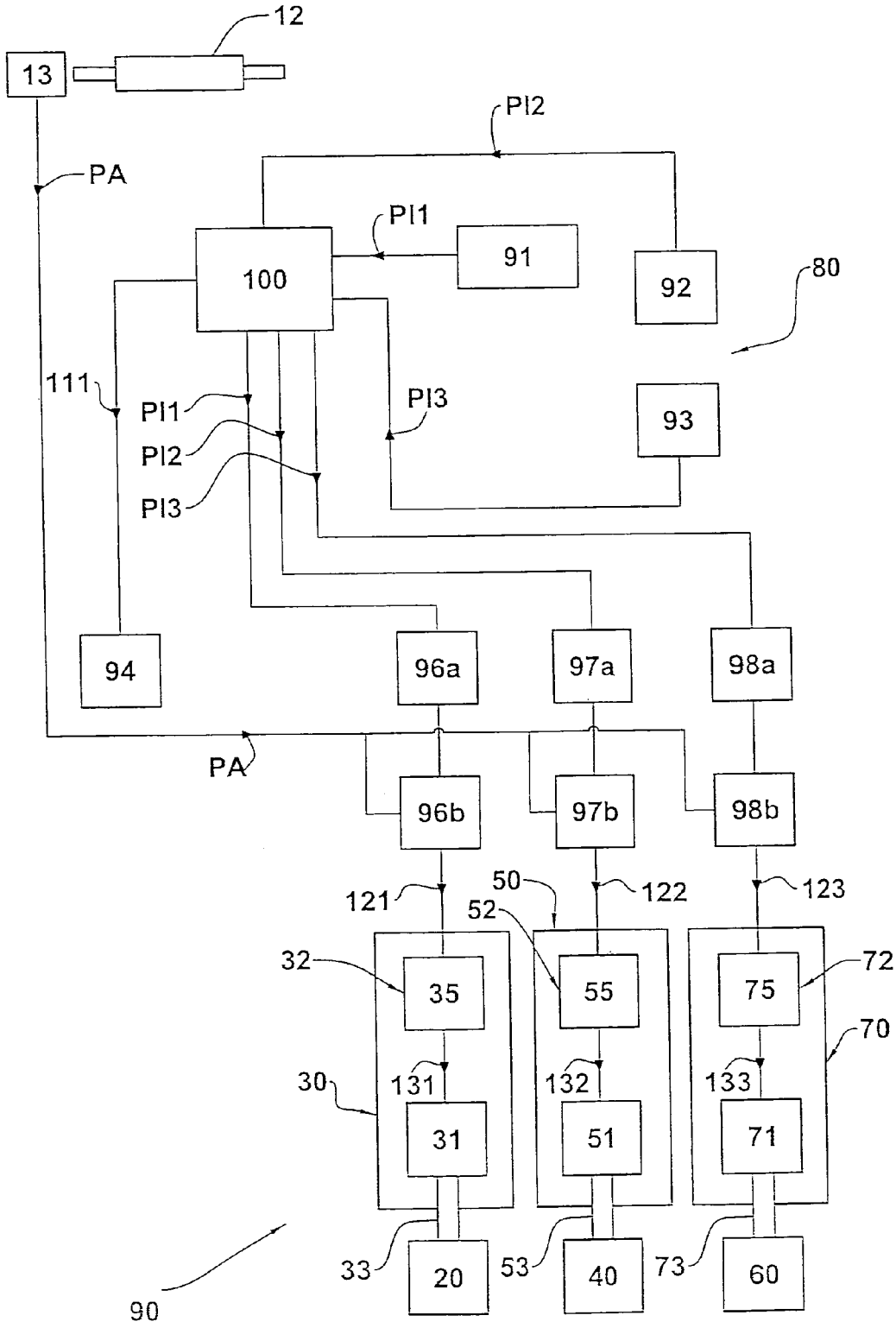
FIG. 5 is a block diagram of the machine in FIG. 1.
Figure 6:
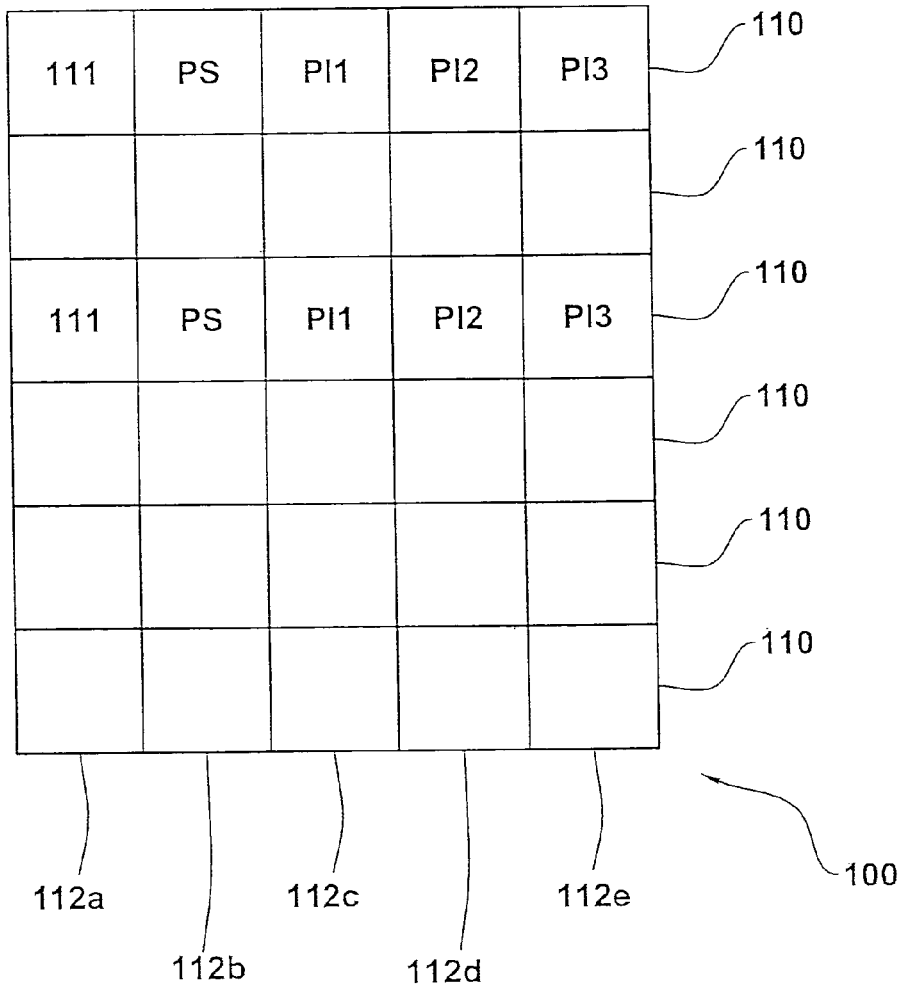
FIG. 6 diagrammatically shows the logic structure of a memory employed in the machine in FIG. 1.

The second feeding member 40 (FIG. 4*b*) is made up of a first roller 41, a second roller 42 and a third roller 43; the first roller 41 has a first bearing arc 41*a* for the weft yarn 19 confined by a first and a second ends 41*b*, 41*c*.

The second roller 42 has a second bearing arc 42*a* confined by a first and a second ends 42*b*, 42*c*; the third roller 43 has a third bearing arc 43*a* having at least one first end 43*b*.

Conveniently, the first, second and third rollers 41, 42, 43 are disposed close to each other so that the second end 41*c* of the first bearing arc 41*a* is coincident with the first end 42*b* of the second bearing arc 42*a*, and the second end 42*c* of the second bearing arc 42*c* is coincident with the first end 43*b* of the third bearing arc 43*a*.

A second electromechanical actuator 50 is connected with the second feeding member 40, to drive said rollers 41, 42, 43 in rotation and supply sickle 6 with the respective weft yarn 19 at a given tension that, as will be better clarified in the following, can be varied during manufacture of the textile product 5.

In more detail, the second electromechanical actuator 50 is made up of an electric motor 51, preferably a brushless motor, and of an electric activation device 52 for powering and controlling motor 51.

The electric motor 51 is provided with an output shaft 53 that, when powered by said activation device 52, is driven in rotation.

The output shaft 53 is connected with the first and preferably the third rollers 41, 43 of the second feeding member 40, whereas the second roller 42 is idly mounted on a respective rotation axis; by varying the rotation speed of the output shaft 53 it is therefore possible to regulate tensioning of the weft yarn 19 when supplied to sickle 6.

A take-down member 60 is positioned close to said sickle 6, knocking-over device 200, compacting reed 201 and needle 8, to engage the textile product 5 and draw it to the exit of machine 1.

The take-down member 60 (FIG. 3*c*) consists of a first roller 61, a second roller 62 and preferably a third roller 63; the first roller 61 has a first bearing arc 61*a* for the textile product 5 having a first and a second ends 61*b*, 61*c*.

The second roller 62 has a second bearing arc 62*a*, delimited by a first and a second ends 62*b*, 62*c*; the third roller 63 has a third bearing arc 63*a* having at least one first end 63*b*.

Conveniently, the first, second and third rollers 61, 62, 63 are disposed close to each other so that the second end 61*c* of the first bearing arc 61*a* is coincident with the first end 62*b* of the second bearing arc 62*a*, and the second end 62*c* of the second bearing arc 62*a* is coincident with the first end 63*b* of the third bearing arc 63*a*.

A third electromechanical actuator 70 is connected with the take-down member 60, to drive said rollers 61, 62, 63 in rotation and draw the textile product 5 according to a given tensioning that, as better clarified in the following, can be varied during manufacture of the textile product 5.

In more detail, the third electromechanical actuator 70 is made up of an electric motor 71, preferably a brushless motor, and of an electric activation device 72 for powering and controlling motor 71. The electric motor 71 is equipped with an output shaft 73 that, when powered by said activation device 72, is driven in rotation.

The output shaft 73 is connected with the first and preferably the third rollers 61, 63 of the second feeding member 60, whereas the second roller 62 is idly mounted on a respective rotation axis; by varying the rotation speed of the output shaft 73 it is therefore possible to regulate the pulling tension of the textile product 5. It will be appreciated that motors 31, 51 and 71 can be either brushless motors or stepping motors.

The textile machine 1 further comprises a main shaft 12 driven in rotation by appropriate actuating means (not shown in the drawings) preferably comprising an electric motor.

The main shaft 12 is used to provide a reference to the synchronized movement of the different members of which the textile machine is made up; in fact, frames 2, sickle 6, knocking-over device 200, compacting reed 201 and needle 8 directly or indirectly derive their position and movement speed from the angular position PA and the rotation speed of the main shaft 12.

Connection between the main shaft 12 and said members 2, 6, 200, 201 and 8 can be of an exclusively mechanical type, consisting of appropriate intermediate kinematic mechanisms, such as glider chains; alternatively, the angular position PA of the main shaft 12 can be detected by a sensor 13 (an encoder, for example) so that a control of the electronic type active on electromechanical actuators connected with said members can keep the latter synchronized with the main shaft 12.

As will be apparent in the following, also the movement of the feeding members 20, 40 and take-down member 60 is synchronized with the rotation of the main shaft 12.

In order to control the whole operation of the machine 1 and the members of which it is comprised, the machine 1 is equipped with a control apparatus 80 that, in addition to said first, second and third electromechanical actuators 30, 50, 70, also comprises a controller 90.

Controller 90 is first of all provided with a memory 100 on which the necessary parameters for regulating operation of the machine 1 are stored.

In more detail, memory 100 contains a plurality of records 110, each of which is associated with a respective weft row of the textile product; records 110 are then disposed in an orderly sequence corresponding to the sequence of the weft rows of the textile product 5.

Each record 110 consists of a plurality of fields, each of which is designed to contain a respective operating parameter of a device of the machine 1.

A first field 112*a* contains a main parameter 111, representative of the weft row corresponding to record 110; the main parameter 111 is conveniently a progressive numeric code: record 110 having the main parameter 111 equal to "1" corresponds to the first weft row that is made, the record having the main parameter equal to "2" corresponds to the second weft row that is made.

A second field 112*b* of record 110 contains a displacement parameter PS, representative of a vertical displacement of at least one frame 2, carried out to make the weft row associated with record 110; the movement width of frames 2 in fact is varied during manufacture of the textile product 5 to obtain particular geometries or decorations thereon, and the displacement parameters PS represent the amount of these displacements.

A third field 112*c* of record 110 contains a first follow-up parameter PI1, associated with the weft row corresponding to said record 110, and representative of a follow-up ratio between the output shaft 33 of motor 31 of the first electromechanical actuator 30 and the main shaft 12.

The first follow-up parameter PI1 is determined, row by row, so as to continuously adjust the follow-up ratio between the output shaft 33 of motor 31 of the first electromechanical actuator 30 and the main shaft 12.

For the purpose, controller 90 is equipped with first calculation means 91 to calculate the first follow-up parameter PI1 depending on the displacement parameter PS belonging to the same record 110; in fact it is important that the amount of the warp yarn 18 supplied by the first feeding member 20 to healds 3 should be suitably adjusted depending on the displacements carried out by frames 2.

A fourth field 112*d* of record 110 holds a second follow-up parameter PI2, associated with the weft row corresponding to this record 110 and representative of a follow-up ratio between the output shaft 53 of motor 51 of the second electromechanical actuator 50 and the main shaft 12.

For determining this second follow-up parameter PI2, controller 90 is provided with second calculation means 92, preferably depending on appropriate data inputted by the user and representative of the type of aesthetic effect or ornament that is wished to be obtained in fabric 5.

A fifth field 112*e* of record 110 holds a third follow-up parameter PI3, associated with the weft row corresponding to this record 110 and representative of a follow-up ratio between the output shaft 73 of motor 71 of the third electromechanical actuator 70 and the main shaft 12.

In order to determine the value of said third follow-up parameter PI3, the control apparatus 80 is provided with third calculation means 93; said means carries out calculation of the third follow-up parameter PI3 in such a manner that it is proportional to the density of stitches per centimeter as inputted by the operator.

In the light of the above, it is apparent that memory 100 of controller 90 has a logic structure quite similar to a table, in which each row is defined by a record 110 and holds all the parameters relating to working of a corresponding weft row of the textile product; on the other hand, each column holds an orderly sequence of parameters relating to a particular element of the machine or the textile product, each of which refers to a specific weft row: the first column holds the main parameters 111 representative of the weft rows and a sequential ordering of same, the second column holds the displacement parameters PS of frames 2, the third column holds the first follow-up parameters PI1, the fourth column holds the second follow-up parameters PI2 and the fifth column holds the third follow-up parameters PI3.

It will be appreciated that the first, second and third calculation means 91, 92, 93 can be incorporated into controller 90 and be therefore positioned close to said members 6, 8, 200, 201.

In this case, once insertion in controller 90 of the numeric chains defined by the succession of displacement parameters PS for frames 2 has occurred, controller 90 is able to determine in an independent manner and row by row, the value that the follow-up parameters PI1, PI2, PI3 must take.

Alternatively, the calculation means 91, 92, 93 can be incorporated in a computer, typically a personal computer (PC), placed at a remote position with respect to members 6, 8, 200, 201 and to the controller 90 associated therewith.

In this way, the computer which is tasked with the most complicated calculations can be positioned in a different place with respect to the mechanical components of the textile machine 1, thus avoiding the correct operation of the computer itself being impaired by vibrations generated by the quick movements of members 6, 8, 200, 201 or the dust formed following working of the different yarns.

The results generated by said computer can be transmitted to controller 90 to be stored in memory 100, through a telematic connection, or by means of a conventional solid state, semiconductor, magnetic or optical storage medium that is transferred from the computer to processor 90 by an operator.

Once the different displacement parameters PS and follow-up parameters PI1, PI2, PI3 have been set, the textile machine 1 can start operating to manufacture the textile product 5.

When the machine 1 and relevant control apparatus 80 are activated, scanning means 94 belonging to controller 90 carries out sequential reading of the main parameters 111 stored in each record 110 of memory 100; practically, the scanning means 94 selects the records 110 one at a time following an orderly succession, in such a manner that the parameters contained in each of them are employed for regulating operation of the machine 1.

In other words, when a record 110 is selected by the scanning means 94, the machine 1 performs a series of actuating steps of its members and/or working steps of the textile product 5 depending on the parameters contained in such a record 110; when reading and use of the parameters in such a record 110 has been completed, the scanning means 94 select the following record for a correct continuation of the machine operation.

In more detail, a first detecting block 96*a* carries out reading within said record 110, of the first follow-up parameter PI1 contained therein; a first transmission block 96*b*, connected with the first detecting block 96*a* and with said sensor 13, sends the first follow-up parameter PI1 and the angular position PA of the main shaft 12 to the activation device 32 of the first actuator 30.

The activation device 32 of the first actuator 30 is provided with first comparator means 35 receiving the first follow-up parameter PI1 and the angular position PA of the main shaft 12 and comparing these two magnitudes.

Depending on this comparison, the first comparator means 35 then sends a first control signal 131 to motor 31 to set the output shaft 33 of motor 31 in rotation with a follow-up ratio with respect to the main shaft 12 that is defined by the first follow-up parameter PI1.

In addition to the above, the electric activation device 32 may comprise an auxiliary control block (not shown in the drawings) consisting of an encoder associated with the output shaft 33 of motor 31, and of a regulation circuit carrying out a feedback control on motor 31 depending on the information about the position of the output shaft 33 detected by said encoder.

In a quite similar manner, reading of the other parameters contained in said record 110 is carried out.

In fact, controller 90 comprises a second detecting block 97*a* to detect the second follow-up parameter PI2 belonging to record 110; a second transmission block 97*b* connected with the second detecting block 97*a* and with sensor 13 sends the second follow-up parameter PI2 and the angular position PA of the main shaft 12 to the activation device 52 of the second actuator 50.

The activation device 52 is provided with second comparator means 55 that, depending on the comparison between the second follow-up parameter PI2 and the angular position PA of the main shaft 12, transmits a second control signal 132 to motor 51 so that the output shaft 53 of said motor 51 is set in rotation with a follow-up ratio relative to the main shaft 12 that is defined by the second follow-up parameter PI2.

The electric activation device 52 too can be provided with en encoder and a regulation circuit connected therewith, to carry out a feedback control on the position and rotation speed of the output shaft 53 of motor 51.

To enable reading of the third follow-up parameter PI3 contained in record 110, controller 90 further comprises a third detecting block 98*a*; also provided is a third transmission block 98*b* connected with the third detecting block 98*a* and with sensor 13.

The third transmission block 98*b* sends the angular position PA of the main shaft 12 and the third follow-up parameter PI3 to the activation device 72 of the third actuator 70; the activation device 72 comprises third comparator means 75 that, following a comparison between the angular position PA of the main shaft 12 and the third follow-up parameter PI3, transmits a third control signal 133 to motor 71.

In this way, the output shaft 73 of motor 71 is driven in rotation with a follow-up ratio with respect to the main shaft 12 that is defined by the third follow-up parameter PI3.

In the same manner as above described with reference to the activation devices 32, 52 of the first and second actuators 30, 50, also the activation device 72 of the third actuator 70 may comprise an encoder and a regulation circuit operatively associated with motor 71 for a closed loop control of the position and rotation speed of the output shaft 73 of the motor 71 itself.

It is apparent that, concurrently with the above described operations, the sickle 6, frames 2, needle 8, knocking-over device 200 and compacting reed 201 are suitably moved, in the manner as previously described.

The above description, as can be noticed, substantially relates to a single record 110 and the weft row associated therewith; through a subsequent scanning carried out by the scanning means 94 the following records are then selected in succession.

It will be appreciated that, due to the technique for operation and control of the above described machine 1, tensioning variations in the weft yarn 19, warp yarns 18 and pulling of the textile product 5 can be obtained without stopping operation of the machine 1, by merely sending appropriate command signals to actuators 30, 50, 70.

In the light of the above, the control method of the textile machine 1 is performed in a manner as described herebelow.

First of all, calculation of the first, second and third follow-up parameters PI1, PI2, PI3 is carried out to define the follow-up ratio between the output shafts 33, 53, 73 of the first, second and third actuators 30, 50, 70, and the main shaft 12.

This calculation occurs for each of the weft rows forming the textile product 5 so that, at each individual movement of sickle 6 and of the other weaving members, each actuator 30, 50, 70 receives a command signal 121, 122, 123 for movement, row by row, of the respective output shaft 33, 53, 73.

Advantageously, the first follow-up parameter PI1 is calculated depending on the displacement parameters PS describing the displacements that are carried out, in succession, by frames 2.

Before the follow-up parameters PI1, PI2, PI3 are transmitted to the respective actuators, the angular position PA of the main shaft 12 is detected.

The first follow-up parameter PI1, together with the angular position PA of the main shaft 12 is incorporated into a first command signal 121 that is transmitted to said comparator means 35 that, after comparing these magnitudes with each other, generates a corresponding first control signal 131 for motor 31 of the first actuator 30.

The method further comprises a step of calculating the second follow-up parameter PI2 for regulation of the second actuator 50; the second follow-up parameter PI2 is calculated depending on appropriate data inputted by the user and representative of the type of aesthetic effect or ornament that is wished to be obtained in the fabric 5.

The second follow-up parameter PI2, together with the angular position PA of the main shaft 12, is incorporated into a second command signal 122 that is sent to the activation device 52 of the second actuator 50.

The comparator means 55 of the activation device 52, upon receiving the second command signal 122 and comparing the second follow-up parameter PI2 with the angular position PA of the main shaft 12, sends a control signal to motor 51 so that the output shaft 53 of motor 51 is set in rotation with a follow-up ratio defined by the second follow-up parameter PI2.

The method further comprises a step of calculating the third follow-up parameter PI3; the third follow-up parameter PI3 is such calculated as to be proportional to the density of stitches/centimeter of fabric inputted by the operator.

In particular, this third follow-up parameter PI3 is obtained as the product between a previously stored data, representative of the desired stitch density (expressed in stitches/centimeter), and a conversion factor that allows the obtained corresponding value to be transmitted to the third actuator 70, so that movement of the take-down member 60 capable of determining the requested stitches/centimeter density is obtained.

The third follow-up parameter PI3, together with the angular position PA of the main shaft 12 is incorporated into a third command signal 123 that is transmitted to the electric activation device 72 of the third actuator 70.

The third comparator means 75, upon reception of the third command signal 123, compares the angular position PA of the main shaft 12 and the third follow-up parameter PI3 with each other and outputs a corresponding third control signal 133 for motor 71, so that the output shaft 73 of said motor 71 is driven in rotation with a follow-up ratio, with respect to the main shaft 12, defined by the third follow-up parameter PI3.

While reference has been hitherto made to the textile machine 1 alone and the method of controlling it, the invention also extends to software programs, in particular programs for computers, stored on a suitable medium to put the invention into practice.

The program can be in the form of a source code, object code, partly source code and partly object code, as well as in the form of partly compiled formats, or any other form that can be employed to implement the method of the present invention.

For example, the medium may comprise storage means such as a ROM memory (a CD-ROM, a semiconductor ROM), a memory of the rewritable type (e.g. flash EPROM) or magnetic storage means (floppy disks or hard disks, for example).

In addition, the medium may be a carrier set for transmission such as an electric or optical signal that can be transmitted through electric or optical cables or radio signals.

When the program is incorporated in a signal that can be directly transmitted through a cable or device or equivalent means, the medium may consist of such a cable, device or equivalent means.

Alternatively, the medium may be an integrated circuit in which the program is incorporated, this integrated circuit being arranged to carry out or employ said method in accordance with the present invention.

The invention achieves important advantages.

First of all, by adjusting the work speed of the first feeding member, in particular depending on the width of movements of the frames, a textile product can be obtained that has optimal aesthetic features, together with ornamental effects in accordance with predetermined patterns.

Another advantage resides in that, by suitably combining the variations in the rotation speeds of the first and second feeding members and the take-down member, particular "special" effects can be obtained in the finished product, that are for example due to alternating thinner portions with more compact portions, to shrinkage and enlargement effects, etc.

Furthermore, the control carried out on machine 1 is very precise due to precision and accuracy of all adjustments ensured by the above described electronic control means.

In addition to the above, by virtue of the simplicity of the operations to be performed for the machine setup, said operations can be carried out by unqualified staff too.

Another advantage comes out with reference to the step of studying new products or fabrics, during which several attempts are to be made and the modalities of operation of the machine are to be correspondingly varied: since these variations are obtained by merely operating on parameters inputted through said electronic control means, very reduced times are required for obtaining the desired product.

In addition, thanks to movement adjustment of the first feeding member with which the warp yarns are in engagement, a precise feeding of said warp yarns can be obtained even in the presence of important weight variations in the beams around which such yarns are wound; said beams in fact have large sizes and are arranged to bear big yarn amounts. Following a progressive unwinding of the yarn itself, each beam can therefore have weight and inertia very different from the starting ones and without said feeding member this fact would result in a progressive but uncheckable variation in tensioning of the supplied warp yarn.

What is claimed is:

1. A textile machine comprising:

at least one frame (2) supporting a plurality of healds (3);

at least one sickle (6);

at least one needle (8);

at least one compacting device (201);

a main shaft (12) associated with said frame (2), sickle (6), needle (8) and compacting device (201), for a synchronised movement of the same and manufacture of a textile product (5), the latter being defined by an orderly succession of weft rows interlaced with warp yarns (18);

a first feeding member (20), to supply a plurality of warp yarns (18) to said sickle (6);

a second feeding member (40), to supply a weft yarn (19) to said sickle (6);

a take-down member (60) of said textile product (5);

a control apparatus (80) provided with:

at least one first electromechanical actuator (30), operatively active on said first or second feeding member (20, 40) or on said take-down member (60), for movement of the same;

a controller (90) for regulation of at least said first actuator (30);

a sensor (13) associated with said main shaft (12) to detect an angular position (PA) of said main shaft (12) and transmit said angular position (PA) to said controller (90).

2. The textile machine as claimed in claim 1, wherein said first actuator (30) comprises:

an electric motor (31) having an output shaft (33) derivable in rotation for movement of said first or second feeding member (20, 40), or of said take-down member (60);

an electric activation device (32) for powering and controlling said motor (31).

3. The textile machine as claimed in claim 2, wherein said controller (90) comprises a first transmission block **(96*b*) connected with said sensor (13) to receive the angular position (PA) of said main shaft (12), and connected with said activation device (32) for transmitting to the latter, a first command signal (121) incorporating said angular position (PA) and a first follow-up parameter (PI1) representative of a follow-up ratio between the output shaft (33) of said motor (31) and said main shaft (12), the activation device (32) of said first actuator (30) being provided with first comparator means (35) to compare said angular position (PA) and first follow-up parameter (PI1) with each other and generate a corresponding first control signal (131) for said motor (31)**.

4. The textile machine as claimed in claim 2, wherein the output shaft (33) of said electric motor (31) is connected with said first feeding member (30) to regulate tensioning of said warp yarns (18) between said first feeding member (30) and frames (2).

5. The textile machine as claimed in claim 4, wherein said first feeding member (20) comprises:

a first roller (21) derivable in rotation by said electric motor (31);

a second roller (22) idly mounted on a respective rotation axis and disposed close to said first roller (21) to engage said warp yarns (18) and feed them to said healds (3)

a third roller (23), derivable in rotation by said electric motor (31) and disposed close to said second roller (22).

6. The textile machine as claimed in claim 3 wherein said controller (90) comprises a memory (100) provided with an orderly sequence of records (110), each associated with a corresponding weft row of said textile product (5) and having:

a first field **(112*a*) containing a main parameter (111)** representative of a corresponding weft row;

a second field **(112*b*) containing a displacement parameter (PS) representative of at least one displacement of said frames (2) carried out at the weft row identified by said main parameter (111)**;

a third field **(112*c*) containing a first follow-up parameter (PI1) associated with the weft row identified by said main parameter (111) and representative of a follow-up ratio between the output shaft (33) of said motor (31) and said main shaft (12)**.

7. The textile machine as claimed in claim 6, said controller (90) further comprises:

scanning means (94) to sequentially read the main parameters (111) stored in said memory (100);

a first detecting block **(96*a*) to detect, at each main parameter (111), the respective first follow-up parameter (PI1) and transmit it to the first comparator means (35) of the electric activation device (32) of said first electromechanical actuator (30)**.

8. The textile machine as claimed in claim 6, characterized in that said control apparatus (80) further comprises first calculation means (91) to calculate the first follow-up parameter (PI1) of a predetermined record (110), depending on the displacement parameter (PS) belonging to said predetermined record (110).

9. The textile machine as claimed in claim 6, wherein said control apparatus (80) further comprises a second electromechanical actuator (50) provided with:

an electric motor (51) having an output shaft (53) derivable in rotation which is connected with said second feeding member (40) for moving the latter and regulating tensioning of said weft yarn (19) between said second feeding member (40) and sickle (6);

an electric activation device (52) for powering and controlling said motor (51).

10. The textile machine as claimed in claim 9, wherein said second feeding member (40) comprises:

a first roller (41) derivable in rotation by the electric motor (51) of said second actuator (50);

a second roller (42) idly mounted on a respective rotation axis and disposed close to said first roller (41) to engage said weft yarn (19) and feed it to said sickle (6) a third roller (43) derivable in rotation by the electric motor (51) of said second actuator (50) and disposed close to said second roller (42).

11. The textile machine as claimed in claim 10, wherein each record (110) of the memory (100) of said controller (90) further has a fourth field **(112*d*)** containing a second follow-up parameter (PI2) associated with the weft row identified by the main parameter (111) of said record (110) and representative of a follow-up ratio between the output shaft (53) of the motor (51) of said second actuator (50) and said main shaft (12).

12. The textile machine as claimed in claim 11, wherein said controller (90) further comprises:

a second detecting block (97*a*) to detect, at each main parameter (111), the respective second follow-up parameter (PI2);

a second transmission block (97*b*) connected with said second detecting block (97*a*) and said sensor (13) to transmit to the activation device (52) of said second actuator (50), a second command signal (122) incorporating the angular position (PA) of said main shaft (12) and said second follow-up parameter (PI2), the activation device (52) of said second actuator (50) being provided with second comparator means (55) to compare said angular position (PA) and second follow-up parameter (PI2) with each other and output a corresponding second control signal (132) for the motor (51) of said second actuator (50).

13. The textile machine as claimed in claim 12, wherein said control apparatus (80) further comprises second calculation means (92) to calculate said second follow-up parameter (PI2).

14. The textile machine as claimed in claim 6, wherein said control apparatus (80) further comprises a third electromechanical actuator (70) provided with:

an electric motor (71) having an output shaft (73) derivable in rotation and connected with said take-down member (60) for movement of the latter and for regulating a pulling tension of said textile product (5);

an electric activation device (72) for powering and controlling said motor (71).

15. The textile machine as claimed in claim 14, wherein said take-down member (60) comprises:

a first roller (61) derivable in rotation by the electric motor (71) of said third actuator (70);

a second roller (62) idly mounted on a respective rotation axis and disposed close to said first roller (61) to draw said textile product (5) and supply it at the exit of said machine (1);

a third roller (63) derivable in rotation by the electric motor (71) of said third actuator (70) and disposed close to said second roller (62).

16. The textile machine as claimed in claim 14, wherein each record (110) of the memory (100) of said controller (90) further has a fifth field (112*e*) containing a third follow-up parameter (PI3) associated with the weft row identified by the main parameter (111) of said record (110) and representative of a follow-up ratio between the output shaft (73) of the electric motor (71) of said third actuator (70) and said main shaft (12).

17. The textile machine as claimed in claim 16, wherein said controller (90) further comprises:

a third detecting block (98*a*) to detect, at each main parameter (111), the respective third follow-up parameter (PI3);

a third transmission block (98*b*) connected with said third detecting block (98*a*) and said sensor (12) to transmit to the activation device (72) of said third actuator (70), a third command signal (123) incorporating the angular position (PA) of said main shaft (12) and said third follow-up parameter (PI3), the activation device (72) of said third actuator (70) being provided with third comparator means (75) for comparing said angular position (PA) and third follow-up parameter (PI3) with each other and output a corresponding third control signal (133) for the motor (71) of said third electromechanical actuator (70).

18. The textile machine as claimed in claim 16, wherein said control apparatus (80) further comprises third calculation means (93) to calculate said third follow-up parameter (PI3), the latter being directly proportional to a rotation speed of the output shaft (73) of the motor (71) of said third actuator (70) and to a previously inputted parameter representative of a density of weft rows per length unit of said textile product (5).

19. A method of controlling a textile machine, said textile machine (1) being provided with:

at least one frame (2) supporting a plurality of healds (3);

at least one sickle (6);

at least one needle (8);

at least one compacting device (201);

a main shaft (12) associated with said frames (2), sickle (6), needle (8) and compacting device (201), and derivable in rotation for a synchronised movement of the same and manufacture of a textile product (5), the latter being defined by an orderly succession of weft rows interlaced with warp yarns (18);

a first feeding member (20), to supply a plurality of warp yarns (18) to said frames (2);

a second feeding member (40), to supply a corresponding weft yarn (19) to said sickle (6);

a take-down member (60) of said textile product (5);

a first electromechanical actuator (30), operatively active on said first feeding member (20), for movement of same;

a second electromechanical actuator (50), operatively active on said second feeding member (40) for movement of same;

a third electromechanical actuator (70), operatively active on said take-down member (60) for movement of same, said method comprising the following steps:

driving said main shaft (12) in rotation;

moving said frames (2), sickle (6), needle (8) and compacting device (201) in synchronism with said main shaft (12) to obtain said textile product (5);

for each weft row of said textile product (5), sending a first command signal (121) to said first electromechanical actuator (30), for a controlled movement of said first feeding member (20).

20. The method as claimed in claim 19, wherein the step of sending said first command signal (121) comprises:

detecting an angular position (PA) of said main shaft (12);

calculating a first follow-up parameter (PI1) representative of a follow-up ratio between an output shaft (33) of said first electromechanical actuator (30) and said main shaft (12);

sending the angular position (PA) of said main shaft (12) and said first follow-up parameter (PI1) to an activation device (32) of said first electromechanical actuator (30), said first command signal (121) incorporating said angular position (PA) and said first follow-up parameter (PI1);

receiving said first command signal (121);

comparing said angular position (PA) and first follow-up parameter (PI1) with each other;

sending a corresponding first control signal (131) to a motor (31) of said first actuator (30), depending on said comparison.

21. The method as claimed in claim 19 further comprising:

for each weft row of said textile product (5), sending a second command signal (122) to said second electromechanical actuator (50), for a controlled movement of said second feeding member (40).

22. The method as claimed in claim 21, wherein the step of sending said second command signal (122) comprises:

detecting an angular position (PA) of said main shaft (12);

calculating a second follow-up parameter (PI2) representative of a follow-up ratio between an output shaft (53) of said second electromechanical actuator (50) and said main shaft (12);

sending the angular position (PA) of said main shaft (12) and said second follow-up parameter (PI2) to an activation device (52) of said second electromechanical actuator (50), said second command signal (122) incorporating said angular position (PA) and said second follow-up parameter (PI2);

receiving said second command signal (122);

comparing said angular position (PA) and said second follow-up parameter (PI2) with each other;

sending a corresponding second control signal (132) to a motor (51) of said second actuator (50), depending on said comparison.

23. The method as claimed in claim 19, further comprising:

for each weft row of said textile product (5), sending a third command signal (123) to said third electromechanical actuator (70), for a controlled movement of said take-down member (60).

24. The method as claimed in claim 23, wherein the step of sending said third command signal (123) comprises:

detecting an angular position (PA) of said main shaft (12);

calculating a third follow-up parameter (PI3) representative of a follow-up ratio between an output shaft (73) of said third electromechanical actuator (70) and said main shaft (12);

sending the angular position (PA) of said main shaft (12) and said third follow-up parameter (PI3) to an activation device (72) of said third electromechanical actuator (70), said third command signal (123) incorporating said angular position (PA) and third follow-up parameter (PI3);

receiving said third command signal (123);

comparing said angular position (PA) and third follow-up parameter (PI3) with each other;

sending a corresponding third control signal (133) to a motor (71) of said third actuator (70), depending on said comparison.

* * * * *

UNITED STATES PATENT AND TRADEMARK OFFICE

CERTIFICATE OF CORRECTION

PATENT NO. : 6,962,172 B2
DATED : November 8, 2005
INVENTOR(S) : Luigi Omodeo Zorini and Pierantonio Franchino It is certified that error appears in the above-identified patent and that said Letters Patent is hereby corrected as shown below:

Column 11,
Lines 46-47, delete “deriv-able” and insert -- drivable --.

Column 12,
Lines 6, 11, 57 and 62, delete “derivable” and insert -- drivable --.
Lines 48-49, delete “deriv-able” and insert -- drivable --.

Column 13,
Lines 30-31, delete “deriv-able” and insert -- drivable --.
Lines 38 and 44, delete “derivable” and insert -- drivable --.

Column 14,
Lines 20-21, delete “deriv-able” and insert -- drivable --.

Signed and Sealed this

Twenty-eighth Day of March, 2006

JON W. DUDAS
*Director of the United States Patent and Trademark Office*